US006525007B2

(12) United States Patent
Okada et al.

(10) Patent No.: US 6,525,007 B2
(45) Date of Patent: Feb. 25, 2003

(54) VISCOSITY MODIFIER FOR LUBRICATING OIL AND LUBRICATING OIL COMPOSITION

(75) Inventors: Keiji Okada, Yamaguchi (JP); Ryousuke Kaneshige, Ichihara (JP)

(73) Assignees: Mitsui Chemicals, Inc., Tokyo (JP); The Lubrizol Corporation, OH (US)

( * ) Notice: Subject to any disclaimer, the term of this patent is extended or adjusted under 35 U.S.C. 154(b) by 0 days.

(21) Appl. No.: 09/876,865

(22) Filed: Jun. 8, 2001

(65) Prior Publication Data

US 2002/0055445 A1 May 9, 2002

Related U.S. Application Data

(63) Continuation-in-part of application No. PCT/JP99/06868, filed on Dec. 8, 1999.

(30) Foreign Application Priority Data

Dec. 9, 1998 (JP) ..... 10-350279
Dec. 9, 1998 (JP) ..... 10-350280

(51) Int. Cl.[7] ..... C07C 9/00; C10M 143/02
(52) U.S. Cl. ..... 508/591; 585/12; 585/18
(58) Field of Search ..... 508/591; 585/12, 585/18

(56) References Cited

U.S. PATENT DOCUMENTS

| | | | | |
|---|---|---|---|---|
| 3,551,336 A | | 12/1970 | Jacobson et al. | |
| 3,691,078 A | | 9/1972 | Johnston et al. | |
| 3,697,429 A | | 10/1972 | Engel et al. | |
| 4,146,492 A | | 3/1979 | Cusano et al. | |
| 4,507,515 A | | 3/1985 | Johnston et al. | |
| 4,666,619 A | | 5/1987 | Kresge et al. | |
| 4,804,794 A | | 2/1989 | Ver Strate et al. | |
| 4,922,046 A | * | 5/1990 | Kinoshita et al. | 585/11 |
| 4,933,099 A | * | 6/1990 | VerStrate | 585/12 |
| 4,959,436 A | | 9/1990 | Cozewith et al. | |
| 4,963,279 A | | 10/1990 | Rosental et al. | |
| 5,068,047 A | | 11/1991 | Chung et al. | |
| 5,094,766 A | | 3/1992 | Kapuscinski et al. | |
| 5,151,204 A | * | 9/1992 | Struglinski | 585/12 |
| 5,217,636 A | * | 6/1993 | Paboucek | 585/10 |
| 5,218,071 A | | 6/1993 | Tsutsui et al. | |
| 5,446,221 A | * | 8/1995 | Struglinski et al. | 585/12 |
| 5,641,736 A | * | 6/1997 | Forbus | 508/469 |
| 5,955,639 A | * | 9/1999 | Oda et al. | 585/10 |
| 6,222,081 B1 | | 4/2001 | Burton et al. | |
| 6,262,324 B1 | * | 7/2001 | Heilmann et al. | 585/12 |
| 2001/0008870 A1 | | 7/2001 | Burton et al. | |

FOREIGN PATENT DOCUMENTS

| | | |
|---|---|---|
| EP | 0129414 | 12/1984 |
| EP | B200351 | 11/1986 |
| EP | 0 299 608 A1 | 1/1989 |
| EP | 0 385 729 A2 | 9/1990 |
| EP | B129414 | 10/1990 |
| EP | 0 422 859 A2 | 4/1991 |
| EP | 0 638 611 A1 | 2/1995 |
| EP | A1638611 | 2/1995 |
| EP | 0902081 | 3/1999 |
| JP | 696624 | 11/1994 |

OTHER PUBLICATIONS

*Macromolecule Analysis Handbook*, Society of Japan Analytical Chemistry, Published by Kinokuniya Shoten, p. 973, 1995 (English translation attached).

Randall et al., "Methylene Sequence Distributions and Number Average Sequence Lengths in Ethylene–Propylene Copolymers"; *American Chemistry Society*, vol. 11, No. 1, Jan.–Feb. 1978, pp. 33–36.

* cited by examiner

*Primary Examiner*—Jacqueline V. Howard
(74) *Attorney, Agent, or Firm*—Birch, Stewart, Kolasch & Birch, LLP

(57) ABSTRACT

The present invention is intended to obtain a viscosity modifier for a lubricating oil, by the use of which a lubricating oil composition of excellent low-temperature properties can be obtained, and to obtain a lubricating oil composition of excellent low-temperature properties containing the viscosity modifier. The viscosity modifier for a lubricating oil comprises an ethylene/propylene copolymer (A) having the properties: the density is in the range of 857 to 882 kg/m$^3$, Mw is in the range of 80,000 to 400,000, Mw/Mn is not more than 2.3, and the density (D (kg/m$^3$)) and the melting point (Tm (° C.)) satisfy the relation $Tm \leqq 1.247 \times D - 1037$; or comprises an ethylene/propylene copolymer (B) having the properties: the ethylene content is in the range of 70 to 79 wt %, Mw is not less than 80,000 and less than 250,000, Mw/Mn is not more than 2.3, Tm is in the range of 15 to 60° C., and the ethylene content (E (wt %)) and the melting point (Tm (° C.)) satisfy the relation $3.44 \times E - 206 \geqq Tm$; or comprises an ethylene/propylene copolymer (C) having the properties: the ethylene content is in the range of 70 to 79 wt %, Mw is in the range of 250,000 to 400,000, Mw/Mn is not more than 2.3, Tm is in the range of 15 to 60° C., and the ethylene content (E (wt %)) and the melting point (Tm (° C.)) satisfy the relation $3.44 \times E - 204 \geqq Tm$. The lubricating oil composition comprises the ethylene/propylene copolymer (A) (B) or (C), a lubricating oil base (D), and if necessary, a pour point depressant.

9 Claims, No Drawings

VISCOSITY MODIFIER FOR LUBRICATING OIL AND LUBRICATING OIL COMPOSITION

This application is a Continuation-In-Part of PCT International Application No. PCT/JP99/06868 filed on Dec. 8, 1999, which was not published in English and which designated the United States and on which priority is claimed under 35 U.S.C. §120, the entire contents of which are hereby incorporated by reference.

TECHNICAL FIELD

The present invention relates to a viscosity modifier for a lubricating oil and a lubricating oil composition. More particularly, the invention relates to a viscosity modifier for a lubricating oil capable of producing a lubricating oil composition having excellent low-temperature properties and a lubricating oil composition containing the viscosity modifier.

BACKGROUND ART

The viscosity of petroleum products generally varies greatly with temperature, and for lubricating oils for automobiles, the temperature dependence of the viscosity is desired to be small. In recent years, therefore, an ethylene/α-olefin copolymer has been widely used as a viscosity modifier having an effect of improving viscosity index for the purpose of decreasing the temperature dependence of the lubricating oils.

When the surrounding temperature lowers, a wax component in a lubricating oil is crystallized and solidified to make the lubricating oil lose flowability, so that a pour point depressant is also contained in the lubricating oil to depress the solidification temperature. The pour point depressant functions to inhibit formation of a three-dimensional network attributed to crystallization of the wax component in the lubricating oil and to depress the pour point of the lubricating oil.

Of the low-temperature properties of a lubricating oil containing a viscosity modifier having an effect of improving viscosity index and a pour point depressant, the viscosity at a high shear rate is determined by compatibility of a lubricating oil base with the viscosity modifier, but on the other hand, the viscosity at a low shear rate is greatly influenced by the pour point depressant. It is known that when an ethylene/α-olefin copolymer having specific composition is used as a viscosity modifier, the effect of the pour point depressant is markedly reduced because of an interaction between the copolymer and the pour point depressant (see U.S. Pat. Nos. 3,697,429 and 3,551,336).

Accordingly, the viscosity modifier to be blended with a lubricating oil which is required to have particularly excellent low-temperature properties is desired to exhibit an excellent effect of improving viscosity index and not to inhibit: the function of the pour point depressant.

As a viscosity modifier satisfying such requirements, an ethylene/α-olefin copolymer, which has an uniform distribution of ethylene units and α-olefin units in the molecules, an ethylene content of 30 to 80% by weight, a weight-average molecular weight of 20,000 to 750,000 and Mw/Mn of less than 2, is disclosed in Japanese Patent Publication No. 96624/1994.

The present inventors have earnestly studied under such circumstances as mentioned above, and as a result, they have found that an ethylene/propylene copolymer having a density, a molecular weight, a molecular weight distribution and a melting point in the specific ranges and having a specific relation between the density and the melting point and an ethylene/propylene copolymer having an ethylene content, a molecular weight, a molecular weight distribution and a melting point in the specific ranges and having a specific relation between the ethylene content and the melting point have an excellent effect of improving viscosity index and do not inhibit the function of the pour point depressant. Based on the finding, the present invention has been accomplished.

For reference, the ethylene/α-olefin copolymer disclosed in the above publication satisfies neither the relation between the ethylene content and the melting point of the ethylene/propylene copolymer nor the relation between the density and the melting point of the ethylene/propylene copolymer specified by the present invention.

OBJECT OF THE INVENTION

It is an object of the present invention to provide a viscosity modifier for a lubricating oil, which comprises a specific ethylene/propylene copolymer and by which a lubricating oil composition having excellent low-temperature properties can be obtained, and to provide a lubricating oil composition containing the viscosity modifier and having excellent low-temperature properties.

DISCLOSURE OF THE INVENTION

One embodiment of the viscosity modifier for a lubricating oil according to the present invention comprises an ethylene/propylene copolymer (A) having the following properties (a-1) to (a-5):

(a-1) the density is in the range of 857 to 882 kg/m$^3$, (a-2) the weight-average molecular weight as measured by gel permeation chromatography is in the range of 80,000 to 400,000 in terms of polystyrene, (a-3) Mw/Mn (Mw: weight-average molecular weight, Mn: number-average molecular weight), which is an indication of a molecular weight distribution, is not more than 2.3, (a-4) the melting point as measured by a differential scanning calorimeter is in the range of 15 to 60° C., and (a-5) the density (D (kg/m$^3$)) and the melting point (Tm (° C.)) as measured by a differential scanning calorimeter satisfy the following relation (I)

$$Tm \leqq 1.247 \times D - 1037 \quad \text{(I).}$$

Another embodiment of the viscosity modifier for a lubricating oil according to the present invention comprises an ethylene/propylene copolymer. (B) having the following properties (b-1) to (b-5):

(b-1) the content of recurring units derived from ethylene is in the range of 70 to 79% by weight, (b-2) the weight-average molecular weight as measured by gel permeation chromatography is not less than 80,000 and less than 250,000 in terms of polystyrene, (b-3) Mw/Mn (Mw: weight-average molecular weight, Mn: number-average molecular weight), which is an indication of a molecular weight distribution, is not more than 2.3, (b-4) the melting point as measured by a differential scanning calorimeter is in the range of 15 to 60° C., and (b-5) the content (E (% by weight)) of recurring units derived from ethylene and the melting point (Tm (° C.))

as measured by a differential scanning calorimeter satisfy the following relation (II)

$$3.44 \times E - 206 \geqq Tm \quad \text{(II)}.$$

A further embodiment of the viscosity modifier for a lubricating oil according to the present invention comprises an ethylene/propylene copolymer (C) having the following properties (c-1) to (c-5):

(c-1) the content of recurring units derived from ethylene is in the range of 70 to 79% by weight, (c-2) the weight-average molecular weight as measured by gel permeation chromatography is in the range of 250,000 to 400,000 in terms of polystyrene, (c-3) Mw/Mn (Mw: weight-average molecular weight, Mn: number-average molecular weight), which is an indication of a molecular weight distribution, is not more than 2.3, (c-4) the melting point as measured by a differential scanning calorimeter is in the range of 15 to 60° C., and (c-5) the content (E (% by weight)) of recurring units derived from ethylene and the melting point (Tm (° C.)) as measured by a differential scanning calorimeter satisfy the following relation (III)

$$3.44 \times E - 204 \geqq Tm \quad \text{(III)}.$$

When the viscosity modifier for a lubricating oil according to the present invention is blended with a lubricating oil, a lubricating oil having excellent low-temperature properties can be obtained.

Embodiments of the lubricating oil composition according to the present invention include:

a lubricating oil composition comprising
(A) the ethylene/propylene copolymer having the above properties (a-1) to (a-5), and
(D) a lubricating oil base, wherein the ethylene/propylene copolymer (A) is contained in an amount of 1 to 20% by weight;

a lubricating oil composition comprising
(B) the ethylene/propylene copolymer having the above properties (b-1) to (b-5), and
(D) a lubricating oil base, wherein the ethylene/propylene copolymer (B) is contained in an amount of 1 to 20% by weight; and a lubricating oil composition comprising
(C.) an ethylene/propylene copolymer having the above properties (c-1) to (c-5), and
(D) a lubricating oil base, wherein the ethylene/propylene copolymer (C) is contained in an amount of 1 to 20% by weight.

Other embodiments of the lubricating oil composition according to the present invention include:

a lubricating oil composition comprising
(A) the ethylene/propylene copolymer having the above properties (a-1) to (a-5),
(D) a lubricating oil base, and
(E) a pour point depressant, wherein the ethylene/propylene copolymer (A) is contained in an amount of 0.1 to 5% by weight and the pour point depressant (E) is contained in an amount of 0.05 to 5% by weight;

a lubricating oil composition comprising
(B) the ethylene/propylene copolymer having the above properties (b-1) to (b-5),
(D) a lubricating oil base, and
(E) a pour point depressant, wherein the ethylene/propylene copolymer (B) is contained in an amount of 0.1 to 5% by weight and the pour point depressant (E) is contained in an amount of 0.05 to 5% by weight; and a lubricating oil composition comprising
(C) an ethylene/propylene copolymer having the above properties (c-1) to (c-5),
(D) a lubricating oil base, and
(E) a pour point depressant, wherein the ethylene/propylene copolymer (C) is contained in an amount of 0.1 to 5% by weight and the pour point depressant (E) is contained in an amount of 0.05 to 5% by weight.

The lubricating oil composition according to the present invention has excellent low-temperature properties.

BEST MODE FOR CARRYING OUT THE INVENTION

The viscosity modifier for a lubricating oil and the lubricating oil composition according to the invention are described in more detail hereinafter.

Viscosity Modifier for Lubricating Oil

An embodiment of the viscosity modifier for a lubricating oil according to the invention comprises the following ethylene/propylene copolymer (A).

Ethylene/propylene Copolymer (A)

The ethylene/propylene copolymer (A) comprises recurring units derived from ethylene and recurring units derived from propylene. Although the ethylene content in the ethylene/propylene copolymer (A) is not specifically limited as far as the density is within such range as mentioned later, it is in the range of usually 70 to 79% by weight, preferably 71 to 78% by weight, more preferably 72 to 78% by weight, still more preferably 73 to 77% by weight, particularly preferably 75 to 77% by weight. The residue is a content of recurring units derived from propylene and the like.

In the present invention, the ethylene content in the ethylene/propylene copolymer is determined by $^{13}$C-NMR in accordance with the method described in "Macromolecule Analysis Handbook" (Society of Japan Analytical Chemistry, edited by Macromolecule Analytical Research Meeting, published by Kinokuniya Shoten).

In the ethylene/propylene copolymer (A), recurring units derived from at least one monomer selected from α-olefins of 4 to 20 carbon atoms, cycloolefins, polyenes and aromatic olefins (hereinafter sometimes referred to as "other monomers") may be contained in amounts of, for example, not more than 5% by weight, preferably not more than 1% by weight, within limits not detrimental to the objects of the invention.

The ethylene/propylene copolymer (A) has a density of 857 to 882 kg/m$^3$, preferably 859 to 880 kg/m$^3$, more preferably 860 to 880 kg/m$^3$, still more preferably 864 to 875 kg/m$^3$, particularly preferably 868 to 875 kg/m$^3$.

When the density is not less than 857 kg/m$^3$, satisfactory low-temperature properties can be obtained. When the density is not more than 882 kg/m$^3$, there is no fear that a lubricating oil composition is partially jellied at low temperatures owing to crystallization of an ethylene sequence portion in the ethylene/propylene copolymer.

The density is measured in accordance with ASTM D1505-85.

The molecular weight of the ethylene/propylene copolymer (A), as measured by gel permeation chromatography, is in the range of 80,000 to 400,000, preferably 100,000 to 380,000, particularly preferably 120,000 to 350,000, in terms of a weight-average molecular weight of polystyrene.

When the weight-average molecular weight is in the above range, the ethylene/propylene copolymer tends to have excellent properties in improving viscosity index. Therefore, a small amount of the ethylene/propylene copolymer suffices to obtain a specific lubricating oil viscosity, and the shear stability of the lubricating oil viscosity is high.

When the molecular weight of the ethylene/propylene copolymer (A), as measured by GPC, is not less than 80,000 and less than 250,000, preferably 100,000 to 240,000, more preferably 120,000 to 240,000, in terms of a weight-average molecular weight of polystyrene, the ethylene/propylene copolymer tends to have excellent properties in improving viscosity index. Therefore, a small amount of the ethylene/propylene copolymer (A) suffices to obtain a specific lubricating oil viscosity, and the shear stability of the lubricating oil viscosity is high.

Further, when the molecular weight of the ethylene/propylene copolymer (A), as measured by GPC, is in the range of 250,000 to 400,000, preferably 260,000 to 380,000, more preferably 270,000 to 350,000, interms of a weigh-average molecular weight of polystyrene, the ethylene/propylene copolymer tends to have excellent properties in improving viscosity index. Therefore, a small amount of the ethylene/propylene copolymer (A) suffices to obtain a specific lubricating oil viscosity, and jellying hardly takes place at low temperatures.

In the present invention, measurement of the weight-average molecular weight in terms of polystyrene by GPC is carried out under the conditions of a temperature of 140° C. and a solvent of orthodichlorobenzene.

The ethylene/propylene copolymer (A) has Mw/Mn (Mw: weight-average molecular weight, Mn: number-average molecular weight), which is an indication of a molecular weight distribution, of not more than 2.3, preferably 1 to 2.2.

If the molecular weight distribution is not more than 2.3, the shear stability of the lubricating oil viscosity becomes good when the copolymer is blended with a lubricating oil base.

The melting point of the ethylene/propylene copolymer (A), as measured by DSC, is in the range of 15 to 60° C., preferably 25 to 50° C., more preferably 25 to 45° C.

The melting point is a measure of an interaction between the ethylene/propylene copolymer and a pour point depressant. In order to prevent the interaction between the copolymer and the pour point depressant and not to inhibit the function of the pour point depressant, it is important that the quantity of the ethylene sequences having a melting point in the vicinity of −5 to +10° C. contained in the copolymer is made as small as possible.

The melting point is determined by obtaining an endothermic curve by means of a differential scanning calorimeter (DSC), and the temperature at the maximum peak position of the endothermic curve is taken as the melting point. More specifically, a sample is placed in an aluminum pan, heated up to 200° C. at a rate of 10° C./min, maintained at 200° C. for 5 minutes, cooled to −150° C. at a rate of 20° C. /min and then heated at a rate of 10° C./min to obtain a 2nd run endothermic curve. From the obtained curve, the melting point is determined.

The number of peak of the endothermic curve of DSC, which indicates a melting point of the ethylene/propylene copolymer (A), is preferably one.

The density (D (kg/m$^3$)) of the ethylene/propylene copolymer (A) and the melting point (Tm (° C.)) thereof as measured by a differential scanning calorimeter satisfy the following relation (I)

$$Tm \leqq 1.247 \times D - 1037 \quad \text{(I)},$$

preferably the following relation (I-a)

$$Tm \leqq 1.247 \times D - 1039 \quad \text{(I-a)}.$$

The formula (I) and the formula (I-a) are each a measure of a composition distribution. When the density and the melting point satisfy the above relation, the composition distribution of the ethylene/propylene copolymer is narrow, so that problems such as lowering of low-temperature properties of a lubricating oil caused by relative increase of the ethylene sequences having a melting point in the vicinity of −5 to +10° C. and opaqueness (haze) of a lubricating oil caused by presence of a high ethylene content portion are not brought about.

When the ethylene/propylene copolymer (A) has a weight-average molecular weight of not less than 80,000 and less than 250,000, the ratio ($\eta$*0.01/$\eta$*8) of its melt viscosity ($\eta$*0.01) at 0.01 rad/sec, as measured at 190° C., to its melt viscosity ($\eta$*8) at 8 rad/sec, as measured at 190° C., is preferably in the range of 1.0 to 2.0. When the ethylene/propylene copolymer (A) has a weight-average molecular weight of 250,000to 400,000, the ratio ($\eta$*0.01/$\eta$*8) is preferably in the range of 1.5 to 2.5.

The melt viscosity ratio mentioned above is a measure of long-chain branches contained in the ethylene/propylene copolymer, and a larger value of the melt viscosity ratio means a larger amount of long-chain branches contained in the copolymer. When the amount of long-chain branches in the ethylene/propylene copolymer is small, a lubricating oil composition containing the ethylene/propylene copolymer exhibits high shear stability of the lubricating oil viscosity.

In the ethylene/propylene copolymer (A) of the invention, the intensity ratio, $S\alpha\beta/S\alpha\alpha > 0.5$, in $^{13}$C-NMR spectrum is one of the preferred embodiment of the present invention.

The $S\alpha\beta$ and $S\alpha\alpha$ measured by the $^{13}$C-NMR spectrum are each a peak intensity of $CH_2$ in the units derived from ethylene or $\alpha$-olefin of 3 or more carbon atoms and they mean two kinds of $CH_2$ different in the position to the tertiary carbon as shown below;

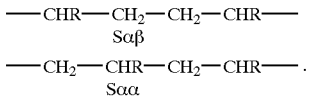

The $^{13}$C-NMR spectrum thus measured was analyzed and then $S\alpha\beta$ and $S\alpha\alpha$ are determined in accordance with the method reported by J. C. Randall (Macromolecules, 11, 33 (1978)).

The intensity ratio $S\alpha\beta/S\alpha\alpha$ is calculated from a ratio of an integral value (area) of each peak. It is generally considered that the thus obtained value of the intensity ratio is a measure indicating a ratio of such reactions as an occurrence of 1-2 addition reaction of $\alpha$-olefin followed by 2-1 addition reaction or an occurrence of 2-1 addition reaction of $\alpha$-olefin followed by 1-2 addition reaction. Consequently, it is indicated that the larger the intensity ratio is, more irregular the bonding direction of $\alpha$-olefin is. On the other hand, the smaller the intensity ratio is, more regular the bonding direction of $\alpha$-olefin is. When the intensity ratio $S\alpha\beta/S\alpha\alpha$ satisfies the above formula ($S\alpha\beta/S\alpha\alpha > 0.5$), heat resistance is particularly excellent.

The ethylene/propylene copolymer (A) having the above properties (a-1) to (a-5) may have the later-described relation (II) or (III) between the ethylene content and the melting point.

The ethylene/propylene copolymer (A) (viscosity modifier for a lubricating oil) exhibits a high effect of improving viscosity index when blended with a lubricating oil base, hardly hinders the function of a pour point depressant and hardly brings about a problem of opaqueness of a lubricating oil. When the ethylene/propylene copolymer (A) is blended with a lubricating oil base, the resulting lubricating oil has excellent flowability at low temperatures and exhibits high shear stability of the lubricating oil viscosity. When the ethylene/propylene copolymer (A) is used as a viscosity modifier, a lubricating oil capable of satisfying low-temperature property standards of the GF-3 standards, which are standards of North America Lubricating Oil Standards of the next generation, can be obtained. Whether the lubricating oil satisfies the GF-3 standards or not can be judged by measuring the later-described CCS and MRV.

The ethylene/propylene copolymer (A) can be obtained by copolymerizing ethylene, propylene, and if necessary, other monomers, in the presence of an olefin polymerization catalyst.

Examples of the olefin polymerization catalysts employable in the preparation of the ethylene/propylene copolymer (A) include catalysts comprising a compound of a transition metal such as vanadium, zirconium or titanium and an organoaluminum compound (organoaluminum oxy-compound) and/or: an ionizing ionic compound. Of these, preferably employed is:

(a) a vanadium catalyst comprising a soluble vanadium compound and an organoaluminum compound, or (b) a metallocene catalyst comprising a metallocene compound of a transition metal selected from Group 4, etc. of the periodic table and an organoaluminum oxy-compound and/or an ionizing ionic compound.

Of the above catalysts, the vanadium catalyst (a) is particularly preferably employed. These catalysts are described later.

Another embodiment of the viscosity modifier for a lubricating oil according to the invention comprises the following ethylene/propylene copolymer (B).

Ethylene/propylene Copolymer (B)

The ethylene/propylene copolymer (B) comprises recurring units derived from ethylene and recurring units derived from propylene. The content of recurring units derived from ethylene (ethylene content) is in the range of usually 70 to 79% by weight, preferably 71 to 78% by weight, more preferably 72 to 78% by weight, still more preferably 73 to 77% by weight, particularly preferably 75 to 77% by weight. The residue is a content of recurring units derived from propylene and the like.

When the ethylene content is not less than 70% by weight, satisfactory low-temperature properties can be obtained. When the ethylene content is not more than 79% by weight, there is no fear that a lubricating oil composition is partially jellied at low temperatures owing to crystallization of an ethylene sequence portion in the ethylene/propylene copolymer.

In the ethylene/propylene copolymer (B), recurring units derived from at least one monomer selected from α-olefins of 4 to 20 carbon atoms, cycloolefins, polyenes and aromatic olefins may be contained in amounts of, for example, not more than 5% by weight, preferably not more than 1% by weight, within limits not detrimental to the objects of the invention.

The molecular weight of the ethylene/propylene copolymer (B), as measured by GPC, is not less than 80,000 and less than 250,000, preferably 100,000 to 240,000, particularly preferably 120,000 to 240,000, of a weight-average molecular weight in terms of polystyrene.

When the weight-average molecular weight is in the above range, the ethylene/propylene copolymer tends to have excellent viscosity index improvability. Therefore, a small amount of the ethylene/propylene copolymer suffices to obtain a specific lubricating oil viscosity, and the shear stability of the lubricating oil viscosity is high.

The ethylene/propylene copolymer (B) has Mw/Mn (Mw: weight-average molecular weight, Mn: number-average molecular weight), which is an indication of a molecular weight distribution, of not more than 2.3, preferably 1 to 2.2.

If the molecular weight distribution is in the above range, the shear stability of the lubricating oil viscosity becomes good when the copolymer is blended with a lubricating oil base.

The melting point of the ethylene/propylene copolymer (B), as measured by a differential scanning calorimeter (DSC), is in the range of 15 to 60° C., preferably 25 to 50° C., more preferably 25 to 45° C.

The melting point is a measure of an interaction between the ethylene/propylene copolymer and a pour point depressant. In order to prevent the interaction between the copolymer and the pour point depressant and not to inhibit the function of the pour point depressant, it is important that the quantity of the ethylene sequences having a melting point in the vicinity of −5 to +10° C. contained in the copolymer is made as small as possible.

The number of peak of the endothermic curve of DSC, which indicates a melting point of the ethylene/propylene copolymer (B), is preferably one.

The ethylene content (E (% by weight)) in the ethylene/propylene copolymer (B) and the melting point (Tm (° C.)) of the copolymer (B) as measured by DSC satisfy the following relation (II)

$$3.44 \times E - 206 \geqq Tm \quad \text{(II)},$$

preferably the following relation (II-a)

$$3.44 \times E - 208 \geqq Tm \quad \text{(II-a)}.$$

The formula (II) and the formula (II-a) are each a measure of a composition distribution. When the ethylene content and the melting point satisfy the above relation (II), the composition distribution of the ethylene/propylene copolymer is narrow, so that problems such as lowering of low-temperature properties of a lubricating oil caused by relative increase of the ethylene sequences having a melting point in the vicinity of −5 to +10° C. and opaqueness (haze) of a lubricating oil caused by presence of a high ethylene content portion are not brought about.

The ratio ($\eta$*0.01/$\eta$*8) of a melt viscosity ($\eta$*0.01) of the ethylene/propylene copolymer (B) at 0.01 rad/sec to a melt viscosity ($\eta$*8) thereof at 8 rad/sec, as measured at 190° C., is preferably in the range of 1.0 to 2.0.

The melt viscosity ratio mentioned above is a measure of long-chain branches contained in the ethylene/propylene copolymer, and a larger value of the melt viscosity ratio means a larger amount of long-chain branches contained in the copolymer. When the amount of long-chain branches in the ethylene/propylene copolymer is small, a lubricating oil composition containing the ethylene/propylene copolymer exhibits high shear stability of the lubricating oil viscosity.

In the ethylene/propylene copolymer (B) of the invention, the intensity ratio, $S\alpha\beta/S\alpha\alpha>0.5$, in $^{13}C$-NMR spectrum is one of the preferred embodiment of the present invention.

The ethylene/propylene copolymer (B) having the above properties (b-1) to (b-5) may have the aforesaid relation (I) between the density and the melting point.

The ethylene/propylene copolymer (B) (viscosity modifier for a lubricating oil) exhibits a high effect of improving viscosity index when blended with a lubricating oil base hardly hinders the function of a pour point depressant and hardly brings about a problem of opaqueness of a lubricating oil. When the ethylene/propylene copolymer (B) is blended with a lubricating oil base, the resulting lubricating oil has excellent flowability at low temperatures and exhibits high shear stability of the lubricating oil viscosity. When the ethylene/propylene copolymer (B) is used as a viscosity modifier, a lubricating oil capable of satisfying low-temperature property standards of the GF-3 standards, which are standards of North America Lubricating Oil Standards of the next generation, can be obtained. Whether the lubricating oil satisfies the GF-3 standards or not can be judged by measuring the later-described CCS and MRV.

The ethylene/propylene copolymer (B) can be obtained by copolymerizing ethylene, propylene, and if necessary, other monomers, in the presence of an olefin polymerization catalyst.

Examples of the olefin polymerization catalysts employable in the preparation of the ethylene/propylene copolymer (B) include catalysts comprising a compound of a transition metal such as vanadium, zirconium or titanium and an organoaluminum compound (organoaluminum oxy-compound) and/or an ionizing ionic compound. Of these, preferably employed is:

(a.) a vanadium catalyst comprising a soluble vanadium compound and an organoaluminum compound, or (b.) a metallocene catalyst comprising a metallocene compound of a transition metal selected from Group 4, etc. of the periodic table and an organoaluminum oxy-compound and/or an ionizing ionic compound.

Of the above catalysts, the vanadium catalyst (a) is particularly preferably employed. These catalysts are described later.

A further embodiment of the viscosity modifier for a lubricating oil according to the invention comprises the following ethylene/propylene copolymer (C).

Ethylene/propylene Copolymer (C)

The ethylene/propylene copolymer (C) comprises recurring units derived from ethylene and recurring units derived from propylene. The ethylene content is in the range of usually 70 to 79% by weight, preferably 71 to 78% by weight, more preferably 72 to 78% by weight, still more preferably 73 to 77% by weight, particularly preferably 75 to 77% by weight. The residue is a content of recurring units derived from propylene and recurring units derived from other monomers described later.

When the ethylene content is not less than 70% by weight, satisfactory low-temperature properties can be obtained. When the ethylene content is not more than 79% by weight, there is no fear that a lubricating oil composition is partially jellied at low temperatures owing to crystallization of an ethylene sequence portion in the ethylene/propylene copolymer.

In the ethylene/propylene copolymer (C), recurring units derived from at least one monomer selected from α-olefins of 4 to 20 carbon atoms, cycloolefins, polyenes and aromatic olefins may be contained in amounts of, for example, not more than 5% by weight, preferably not more than 1% by weight, within limits not detrimental to the objects of the invention.

The molecular weight of the ethylene/propylene copolymer (C), as measured by GPC, is in the range of 250,000 to 400,000, preferably 260,000 to 380,000, more preferably 270,000 to 350,000, of a weight-average molecular weight in terms of polystyrene.

When the weight-average molecular weight is in the above range, the ethylene/propylene copolymer tends to have excellent viscosity index improvability. Therefore, a small amount of the ethylene/propylene copolymer suffices to obtain a specific lubricating oil viscosity, and jellying hardly takes place at low temperatures.

The ethylene/propylene copolymer (C) has Mw/Mn (Mw: weight-average molecular weight, Mn: number-average molecular weight):, which is an indication of a molecular weight distribution, of not more than 2.3, preferably 1 to 2.2.

If the molecular weight distribution is in the above range, the shear stability of the lubricating oil viscosity becomes good when the copolymer is blended with a lubricating oil base.

The melting point of the ethylene/propylene copolymer (C), as measured by DSC, is in the range of 15 to 60° C., preferably 25 to 50° C., more preferably 25 to 45° C.

The melting point is a measure of an interaction between the ethylene/propylene copolymer and a pour point depressant. In order to prevent the interaction between the copolymer and the pour point depressant and not to inhibit the function of the pour point depressant, it is important that the quantity of the ethylene sequences having a melting point in the vicinity of −5 to +10° C. contained in the copolymer is made as small as possible.

The number of peak of the endothermic curve of DSC, which indicates a melting point of the ethylene/propylene copolymer (C), is preferably one.

The ethylene content (E (% by weight)) in the ethylene/propylene copolymer (C) and the melting point (Tm (° C.)) of the copolymer (C) as measured by DSC satisfy the following relation (III)

$$3.44\times E-204\geqq Tm \quad \text{(III)},$$

preferably the following relation (III-a)

$$3.44\times E-206\geqq Tm \quad \text{(III-a)}.$$

The formula (III) and the formula (III-a) are each a measure of a composition distribution. When the ethylene content and the melting point satisfy the above relation (III), the composition distribution of the ethylene/propylene copolymer is narrow, so that problems such as lowering of low-temperature properties of a lubricating oil caused by relative increase of the ethylene sequences having a melting point in the vicinity of −5 to +10° C. and opaqueness (haze) of a lubricating oil caused by presence of a high ethylene content portion are not brought about.

The ratio ($\eta^*0.01/\eta^*8$) of a melt viscosity ($\eta^*0.01$) of the ethylene/propylene copolymer (C) at 0.01 rad/sec to a melt viscosity ($\eta^*8$) thereof at 8 rad/sec, as measured at 190° C., is preferably in the range of 1.5 to 2.5.

The melt viscosity ratio mentioned above is a measure of long-chain branches contained in the ethylene/propylene copolymer, and a larger value of the melt viscosity ratio means a larger amount of long-chain branches contained in the copolymer. When the amount of long-chain branches in the ethylene/propylene copolymer is small, a lubricating oil composition containing the ethylene/propylene copolymer exhibits high shear stability of the lubricating oil viscosity.

In the ethylene/propylene copolymer (C) of the invention, the intensity ratio, $S\alpha\beta/S\alpha\alpha>0.5$, in $^{13}$C-NMR spectrum is one of the preferred embodiment of the present invention.

The ethylene/propylene copolymer (C) having the above properties (c-1) to (c-5) may have the aforesaid relation (I) between the density and the melting point.

The ethylene/propylene copolymer (C) (viscosity modifier for a lubricating oil) exhibits a high effect of improving viscosity index when blended with a lubricating oil base, hardly hinders the function of a pour point depressant and hardly brings about a problem of opaqueness of a lubricating oil. When the ethylene/propylene copolymer (C) is blended with a lubricating oil base, the resulting lubricating oil has excellent flowability at low temperatures and exhibits high shear stability of the lubricating oil viscosity. When the ethylene/propylene copolymer (C) is used as a viscosity modifier, a lubricating oil capable of satisfying low-temperature property standards of the GF-3 standards, which are standards of North America Lubricating Oil Standards of the next generation, can be obtained. Whether the lubricating oil satisfies the GF-3 standards or not can be judged by measuring the later-described CCS and MRV.

The ethylene/propylene copolymer (C) can be obtained by copolymerizing ethylene, propylene, and if necessary, other monomers, in the presence of an olefin polymerization catalyst.

Examples of the olefin polymerization catalysts employable in the preparation of the ethylene/propylene copolymer (C) include catalysts comprising a compound of a transition metal such as vanadium, zirconium or titanium and an orgahoaluminum compound (organoaluminum oxy-compound) and/or an ionizing ionic compound. Of these, preferably employed is:

(a) a vanadium catalyst comprising a soluble vanadium compound and an organoaluminum compound, or (b) a metallocene catalyst comprising a metallocene compound of a transition metal selected from Group 4, etc. of the periodic table and an organoaluminum oxy-compound and/or an ionizing ionic compound.

Of the above catalysts, the vanadium catalyst (a) is particularly preferably employed.

Olefin Polymerization Catalyst

The olefin polymerization catalyst used in the preparation of the ethylene/propylene copolymer (A), (B) or (C) is described below.

In the preparation of the ethylene/propylene copolymer (A), preferably used is:

(a) a vanadium catalyst comprising a soluble vanadium compound and an organoaluminum compound, or (b) a metallocene catalyst comprising a metallocene compound of a transition metal selected from Group 4, etc. of the periodic table and an organoaluminum oxy-compound and/or an ionizing ionic compound;

more preferably used is:

(a-1) a vanadium catalyst comprising a soluble vanadium compound (v-1) and an organoaluminum compound; and particularly preferably used is:

(a-2) a vanadium catalyst comprising a soluble vanadium compound (v-2) and an organoaluminum compound.

In the preparation of the ethylene/propylene copolymer (B), preferably used is:

(a) a vanadium catalyst comprising a soluble vanadium compound and an organoaluminum compound, or (b) a metallocene catalyst comprising a metallocene compound of a transition metal selected from Group 4, etc. of the periodic table and an organoaluminum oxy-compound and/or an ionizing ionic compound; and particularly preferably used is:

(a-2) a vanadium catalyst comprising a soluble vanadium compound (v-2) and an organoaluminum compound.

In the preparation of the ethylene/propylene copolymer (C), preferably used is:

(a) a vanadium catalyst comprising a soluble vanadium compound (v-1) and an organoaluminum compound, or (b) a metallocene catalyst comprising a metallocene compound of a transition metal selected from Group 4, etc. of the periodic table and an organoaluminum oxy-compound and/or an ionizing ionic compound;

more preferably used is:

(a-1) a vanadium catalyst comprising a soluble vanadium compound (v-1) and an organoaluminum compound; and particularly preferably used is:

(a-2) a vanadium catalyst comprising a soluble vanadium compound (v-2) and an organoaluminum compound.

Soluble Vanadium Compound (v-1)

The soluble vanadium compound (v-1) for forming the vanadium catalyst (a-1) that is preferably used in the preparation of the ethylene/propylene copolymer (A) or (C) is represented by the following formula.

$$VO(OR)_aX_b \text{ or } V(OR)_cX_d$$

In the above formulas, R is a hydrocarbon group, such as an alkyl group, a cycloalkyl group or an aryl group; X is a halogen atom; and a, b, c and d are numbers satisfying the conditions of $0\leqq a\leqq 3$, $0\leqq b\leqq 3$, $2\leqq a+b\leqq 3$, $0\leqq c\leqq 4$, $0\leqq d\leqq 4$ and $3\leqq c+d\leqq 4$.

Examples of the soluble vanadium compounds (v-1) represented by the above formulas include $VOCl_3$, $VO(OCH_3)Cl_2$, $VO(OC_2H_5)Cl_2$, $VO(OC_2H_5)_{1.5}Cl_{1.5}$, $VO(OC_2H_5)_2Cl$, $VO(O\text{-}n\text{-}C_3H_7)Cl_2$, $VO(O\text{-}iso\text{-}C_3H_7)Cl_2$, $VO(O\text{-}n\text{-}C_4H_9)Cl_2$, $VO(O\text{-}iso\text{-}C_4H_9)_2Cl$, $VO(O\text{-}sec\text{-}C_4H_9)Cl_2$, $VO(O\text{-}t\text{-}C_4H_9)Cl_2$, $VO(OC_2H_5)_3$, $VOBr_2$, $VCl_4$, $VOCl_2$, $VO(O\text{-}n\text{-}C_4H_9)_3$ and $VOCl_3\cdot 2OC_8H_{17}OH$.

Of the soluble vanadium compounds (v-1), the following soluble vanadium compound (v-2) is preferable.

Soluble Vanadium Compound (v-2)

The soluble vanadium compound (v-2) for forming the vanadium catalyst (a-2) that is preferably used in the preparation of the ethylene/propylene copolymer (A) ,(B) or (C) is represented by the following formula.

$$VO(OR)_aX_b \text{ or } V(OR)_cX_d$$

In the above formulas, R is a hydrocarbon group, such as an alkyl group, a cycloalkyl group or an aryl group; X is a halogen atom; and a, b, c and d are numbers satisfying the conditions of $0>a\leqq 3$, $0\leqq b>3$, $2\leqq a+b\leqq 3$, $0>c\leqq 4$, $0\leqq d>4$ and $3\leqq c+d\leqq 4$. a is preferably a number satisfying the condition of $1>a\leqq 3$, and c is preferably a number satisfying the condition of $1>c\leqq 3$.

Examples of the soluble vanadium compounds (v-2) represented by the above formulas include $VO(OCH_3)Cl_2$, $VO(OC_2H_5)Cl_2$, $VO(OC_2H_5)_{1.5}Cl_{1.5}$, $VO(OC_2H_5)_2Cl$, $VO(O\text{-}n\text{-}C_3H_7)Cl_2$, $VO(O\text{-}iso\text{-}C_3H_7)Cl_2$, $VO(O\text{-}n\text{-}C_4H_9)Cl_2$, $VO(O\text{-}iso\text{-}C_4H_9)Cl_2$, $VO(O\text{-}sec\text{-}C_4H_9)Cl_2$, $VO(O\text{-}t\text{-}C_4H_9)Cl_2$, $VO(OC_2H_5)_3$ and $VO(O\text{-}n\text{-}C_4H_9)_3$.

Organoaluminum Compound

The organoaluminum compound for forming the vanadium catalyst (a-1) that is preferably used in the preparation of the ethylene/propylene copolymer (A) or (C) and the organoaluminum compound for forming the vanadium catalyst (a-2) that is preferably used in the preparation of the ethylene/propylene copolymer (A), (B) or (C) are represented by the following formula (i):

$$R^1_nAlX^1_{3-n} \quad \text{(i)}$$

wherein $R^1$ is a hydrocarbon group of 1 to 15 carbon atoms, preferably 1 to 4 carbon atoms, $X^1$ is a halogen atom or a hydrogen atom, and n is 1 to 3.

The hydrocarbon group of 1 to 15 carbon atoms is, for example, an alkyl group, a cycloalkyl group or an aryl group. Examples of such groups include methyl, ethyl, n-propyl, isopropyl, isobutyl, pentyl, hexyl, octyl, cyclopentyl, cyclohexyl, phenyl and tolyl.

Examples of the organoaluminum compounds include:

trialkylaluminums, such as trimethylaluminum, triethylaluminum, triisopropylaluminum, triisobutylaluminum, trioctylaluminum and tri-2-ethylhexylaluminum;

alkenylaluminums represented by the formula $(i\text{-}C_4H_9)_xAl_y(C_5H_{10})_z$ (wherein x, y and z are each a positive number, and $z \geqq 2x$), such as isoprenylaluminum;

trialkenylaluminums, such as triisopropenylaluminum;

dialkylaluminum halides, such as dimethylaluminum chloride, diethylaluminum chloride, diisopropylaluminum chloride, diisobutylaluminum chloride and dimethylaluminum bromide;

alkylaluminum sesquihalides, such as methylaluminum sesquichloride, ethylaluminum sesquichloride, isopropylaluminum sesquichloride, butylaluminum sesquichloride and ethylaluminum sesquibromide, aikylaluminum dihalides, such as methylaluminum dichloride, ethylaluminum dichloride, isopropylaluminum dichloride and ethylaluminum dibromide;

dialkylaluminum hydrides, such as diethylaluminum hydride and dibutylaluminum hydride; and alkylaluminum dihydrides, such as ethylaluminum dihydride and propylaluminum dihydride.

Metallocene Compound

The metallocene compound of a transition metal of Group 4 of the periodic table for forming the metallocene catalyst (b) that is preferably used in the preparation of the ethylene/propylene copolymer (A), (B) or (C) is represented by the following formula (ii).

$$ML_x \quad \text{(ii)}$$

In the formula (ii), M is a transition metal selected from Group 4 of the periodic table, specifically zirconium, titanium or hafnium, and x is a number satisfying a valence of the transition metal.

L is a ligand coordinated to the transition metal, and of the ligands, at least one ligand L is a ligand having cyclopentadienyl skeleton. The ligand having cyclopentadienyl skeleton may have a substituent group.

Examples of the ligands having cyclopentadienyl skeleton include a cyclopentadienyl group; and alkyl-substituted or cycloalkyl-substituted cyclopentadienyl groups, such as methylcyclopentadienyl, ethylcyclopentadienyl, n- or i-propylcyclopentadienyl, n-, i-, sec- or tert-butylcyclopentadienyl, hexylcyclopentadienyl, octylcyclopentadienyl, dimethylcyclopentadienyl, trimethylcyclopentadienyl, tetramethylcyclopentadienyl, pentarmethylcyclopentadienyl, methylethylcyclopentadienyl, methylpropylcyclopentadienyl, methylbutylcyclopentadienyl, methylhexylcyclopentadienyl, methylbenzylcyclopentadienyl, ethylbutylcyclopentadienyl, ethylhexylcyclopentadienyl and methylcyclohexylcyclopentadienyl; an indenyl group; a 4,5,6,7-tetrahydroindenyl group; and a fluorenyl group.

These groups may be substituted with halogen atoms and trialkylsilyl groups.

Of the above groups, alkyl-substituted cyclopentadienyl groups are particularly preferable.

When the compound represented by the formula (ii) contains two or more groups having cyclopentadienyl skeleton as the ligands L, two of them may be bonded through an alkylene group such as ethylene or propylene, a substituted alkylene group such as isopropylidene or diphenylmethylene, a silylene or a substituted silylene group such as dimethylsilylene group, diphenylsilylene or methylphenylsilylene.

The ligand L other than the ligand having cyclopentadienyl skeleton is, for example, a hydrocarbon group of 1 to 12 carbon atoms, an alkoxy group, an aryloxy group, a sulfonic acid-containing group ($—SO_3R^a$ wherein $R^a$ is an alkyl group, a halogen-substituted alkyl group, an aryl group, a halogen-substituted aryl group or an alkyl-substituted aryl group); a halogen atom or a hydrogen atom.

Examples of the hydrocarbon groups of 1 to 12 carbon atoms include alkyl groups, cycloalkyl groups, aryl groups and aralkyl groups. More specifically, there can be mentioned:

alkyl groups, such as methyl, ethyl, n-propyl, isopropyl, n-butyl, isobutyl, sec-butyl, tert-butyl, pentyl, hexyl, octyl, decyl and dodecyl;

cycloalkyl groups, such as cyclopentyl and cyclohexyl;

aryl groups, such as phenyl and tolyl; and aralkyl groups, such as benzyl and neophyl.

Examples of the alkoxy groups include methoxy, ethoxy, n-propoxy, isopropoxy, n-butoxy, isobutoxy, sec-butoxy, tert-butoxy, pentoxy, hexoxy and octoxy.

An example of the aryloxy group is phenoxy.

Examples of the sulfonic acid-containing groups ($—SO_3R^a$) include methanesulfonato, p-toluenesulfonato, trifluoromethanesulfonato and p-chlorobenzenesulfonato.

The halogen atom is fluorine, chlorine, bromine or iodine.

Examples of the metallocene compounds having zirconium as M and containing two ligands having cyclopentadienyl skeleton include:

bis(methylcyclopentadienyl)zirconium dichloride,
bis(ethylcyclopentadienyl)zirconium dichloride,
bis(n-propylcyclopentadienyl)zirconium dichloride,
bis(indenyl)zirconium dichloride, and
bis(4,5,6,7-tetrahydroindenyl)zirconium dichloride.

Compounds wherein the zirconium metal is replaced with a titanium metal or a hafnium metal in the above-mentioned zirconium compounds are also employable.

A compound represented by the following formula (iii) is also employable as the metallocene compound for forming the metallocene catalyst that is preferably used in the preparation of the ethylene/propylene copolymer (A), (B) or (C).

$$L^1M^1X^2 2 \quad \text{(iii)}$$

In the formula (iii), $M^1$ is a metal of Group 4 of the periodic table or a metal of lanthanide series.

$L^1$ is a derivative of a delocalized π-bonding group and imparts a restraint geometric shape to the active site of the metal $M^1$.

Each $X^2$ may be the same or different and is hydrogen, halogen, a hydrocarbon group containing 20 or less carbon atoms, a silyl group containing 20 or less silicon atoms, or a germyl group containing 20 or less germanium atoms.

Of the compounds represented by the formula (iii), a compound represented by the following formula (iv) is preferable.

(iv)

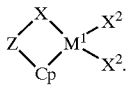

In the above formula, $M^1$ is titanium, zirconium or hafnium, and $X^2$ is the same as above.

Cp is a cyclopentadienyl group π-bonded to $M^1$.

Z is oxygen, sulfur, boron or an element of Group 14 of the periodic table (e.g., silicon, germanium or tin).

Y is a ligand containing nitrogen, phosphorus, oxygen or sulfur.

Z and Y may together form a condensed ring.

Examples of the metallocene compounds represented by the formula (iv) include:

(dimethyl(t-butylamido)(tetramethyl-$\eta^5$-cyclopentadie nyl) silane)titanium dichloride, ((t-butylamido)(tetramethyl-$\eta^5$-cyclopentadienyl)-1,2-ethanediyl)titanium dichloride, (dibenzyl(t-butylamido)(tetramethyl-$\eta^5$-cyclopentadie nyl) silane)titanium dichloride, (dimethyl(t-butylamido)(tetramethyl-$\eta^5$-cyclopentadie nyl) silane)dibenzyltitanium, (dimethyl(t-butylamido)(tetramethyl-$\eta^5$-cyclopentadie nyl) silane)dimethyltitanium, ((t-butylamido)(tetramethyl-$\eta^5$-cyclopentadienyl)-1,2-ethanediyl)dibenzyltitanium, ((methylamido)(tetramethyl-$\eta^5$-cyclopentadienyl)-1,2-ethanediyl) dineopentyltitanium, ((phenylphosphido)(tetramethyl-$\eta^5$-cyclopentadienyl)m ethylene)diphenyltitanium, (dibenzyl(t-butylamido)(tetramethyl-$\eta^5$-cyclopentadie nyl) silane)dibenzyltitanium, (dimethyl(benzylamido)($\eta^5$-cyclopentadienyl)silane)di (trimethylsilyl)titanium, (dimethyl(phenylphosphido)(tetramethyl-$\eta^5$-cyclopenta dienyl)silane)dibenzyltitanium, ((tetramethyl-$\eta^5$-cyclopentadienyl)-1,2-ethanediyl)di benzyltitanium, (2-$\eta^5$-(tetramethyl-cyclopentadienyl)-1-methyl-ethano late (2-))dibenzyltitanium, (2-$\eta^5$-(tetramethyl-cyclopentadienyl)-1-methyl-ethano late (2-))dimethyltitanium, (2-((4a,4b,8a,9,9a-η)-9H-fluorene-9-yl)cyclohexanola te(2-))dimethyltitanium, and (2-((4a,4b,8a,9,9a-η)-9H-fluorene-9-yl)cyclohexanola te(2-))dibenzyltitanium.

Compounds wherein the titanium metal is replaced with a zirconium metal or a hafnium metal in the above-mentioned titanium compounds are also employable.

The metallocene compounds mentioned above can be used singly or in combination of two or more kinds.

In the present invention, a zirconocene compound having zirconium as the central metal atom and containing two ligands having cyclopentadienyl skeleton is preferably used as the metallocene compound represented by the formula (ii). As the metallocene compound represented by the formula (iii) or (iv), a titanocene compound having titanium as the central metal atom is preferably used. Of the metallocene compounds mentioned above, a compound represented by the formula (iv) and having titanium as the central metal atom is particularly preferable.

Organoaluminum Oxy-compound

The organoaluminum oxy-compound for forming the metallocene catalyst (b) may be aluminoxane hitherto known or a benzene-insoluble organoaluminum oxy-compound.

The hitherto known aluminoxane is represented by the following formula:

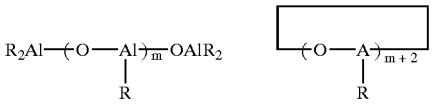

wherein R is a hydrocarbon group, such as methyl, ethyl, propyl or butyl, preferably methyl or ethyl, particularly preferably methyl; and m is an integer of 2 or more, preferably an integer of 5 to 40.

The aluminoxane maybe composed of mixed alkyloxy-aluminum units consisting of alkyloxyaluminum units represented by the formula, OAl ($R^1$) and alkyloxyaluminum units represented by the formula OAl ($R^2$) ($R^1$ and $R^2$ are each the same hydrocarbon group as described with respect to R, and $R^1$ and $R^2$ are groups different from each other).

Ionizing Ionic Compound

Examples of the ionizing ionic compounds for forming the metallocene catalyst (b) include Lewis acid and an ionic compound.

The Lewis acid is, for example, a compound represented by $BR_3$ (R is fluorine or a phenyl group which may have a substituent group selected from fluorine, methyl, trifluoromethyl and the like). Examples of such compounds include: trifluoroboron, triphenylboron, tris(4-fluorophenyl)boron, tris(3,5-difluorophenyl)boron, tris(4-fluoromethylphenyl) boron, tris(pentafluorophenyl)boron, tris(p-tolyl)boron, tris (o-tolyl)boron and tris(3,5-dimethylphenyl)boron.

The ionic compound is, for example, a trialkyl-substituted ammonium salt, a N,N-dialkylanilinium salt, a dialkylammonium salt or a triarylphosphonium salt.

Examples of the trialkyl-substituted ammonium salts include triethylammoniumtetra(phenyl)boron, tripropylammoniumtetra(phenyl)boron, tri(n-butyl) ammoniumtetra(phenyl)boron, trimethylammoniumtetra(p-tolyl)boron, trimethylammoniumtetra(o-tolyl)boron, tributylammoniumtetra(pentafluorophenyl)boron, tripropylammoniumtetra(o,p-dimethylphenyl)boron, tributylammoniumtetra(m,m-dimethylphenyl)boron, tributylammoniumtetra(p-trifluoromethylphenyl)boron and tri(n-butyl)ammoniumtetra(o-tolyl)boron.

Examples of the N,N-dialkylanilinium salts include N,N-dimethylaniliniumtetra(phenyl)boron, N,N-diethylaniliniumtetra(phenyl)boron and N,N-2,4,6-pentamethylaniliniumtetra(phenyl)boron.

Examples of the dialkylammonium salts include di(1-propyl)ammoniumtetra(pentafluorophenyl)boron and dicyclohexylammoniumtetra(phenyl)boron.

Also employable as the ionic compound is triphenylcarbeniumtetrakis(pentafluorophenyl)borate, N,N-dimethylaniliniumtetrakis(pentafluorophenyl)borate or ferroceniumtetra(pentafluorophenyl)borate.

For forming the metallocene catalyst, the aforesaid organoaluminum compound may be used together with the organoaluminum oxy-compound and/or the ionizing ionic compound.

Preparation of Ethylene/propylene Copolymer (A)

The ethylene/propylene copolymer (A) is prepared by copolymerizing ethylene, propylene, and if necessary, other monomers in the presence of preferably the vanadium catalyst (a-1) (more preferably the vanadium catalyst (a-2)) or the metallocene catalyst generally in a liquid phase. In the copolymerization, a hydrocarbon solvent is generally used as a polymerization solvent, but an α-olefin such as liquid propylene may be used.

Examples of the hydrocarbon solvents used in the polymerization include a liphatic hydrocarbons, such as pentane, hexane, heptane, octane, decane, dodecane and kerosine, and halogen derivatives thereof; alicyclic hydrocarbons, such as cyclohexane, methylcyclopentane and methylcyclohexane, and halogen derivatives thereof; and aromatic hydrocarbons, such asbenzene, toluene and xylene, and halogen derivatives thereof such as chlorobenzene. These hydrocarbon solvents can be used singly or in combination of two or more kinds.

Although ethylene, propylene, and if necessary, other monomers can be copolymerized by any of batchwise and continuous processes, the copolymerization is preferably carried out continuously, and is particularly preferably carried out continuously using a stirring vessel type reactor. When the copolymerization is carried out continuously, the catalyst is used in, for example, the following concentration.

When the vanadium catalyst (a-1) is used as a catalyst, the concentration of the soluble vanadium compound (v-1) in the polymerization system is in the range of usually 0.01 to 5 mmol/liter (polymerization volume), preferably 0.05 to 3 mmol/liter. It is desirable to feed the soluble vanadium compound (v-1) in a concentration of usually not more than 10 times, preferably 1 to 7 times, more preferably 1 to 5 times, the concentration of the soluble vanadium compound (v-1) present in the polymerization system. The organoaluminum compound is fed in such an amount that the molar ratio (Al/V) of the aluminum atom to the vanadium atom in the polymerization system becomes usually not less than 2, preferably 2 to 50, more preferably 3 to 20.

The soluble vanadium compound (v-1) and the organoaluminum compound are generally fed after diluted with the aforesaid hydrocarbon solvent and/or liquid propylene. The soluble vanadium compound (v-1) is desirably diluted to the above-mentioned concentration. On the other hand, the organoailuminum compound is desirably adjusted to, for example, an arbitrary concentration of not more than 50 times the concentration thereof in the polymerization system, followed by feeding to the polymerization system.

In the copolymerization of ethylene, propylene, and if necessary, other monomers in the presence of the vanadium catalyst (a-1), the copolymerization reaction is carried out under the conditions of a temperature of usually −50 to 100° C., preferably −30 to 80° C., more preferably −20 to 60° C., and a pressure of more than 0 kg/cm$^2$ and not more than 50 kg/cm$^2$, preferably more than 0 kg/cm$^2$ and not more than 20 kg/cm$^2$. In a continuous polymerization process, these polymerization conditions are preferably held constant.

Also in the copolymerization of ethylene, propylene, and if necessary, other monomers in the presence of the vanadium catalyst (a-2), the same catalyst concentration and copolymerization conditions as described above are adopted.

When the metallocene catalyst (b) is used as a catalyst, the concentration of the metallocene compound in the polymerization system is in the range of usually 0.00005 to 0.1 mmol/liter (polymerization volume), preferably 0.0001 to 0.05 mmol/liter. The organoaluminum oxy-compound is fed in such an amount that the molar ratio (Al/transition metal) of the aluminum atom to the transition metal in the metallocene compound in the polymerization system becomes usually 1 to 10000, preferably 10 to 5000.

The ionizing ionic compound is fed in such an amount that the molar ratio (ionizing ionic compound/metallocene compound) of the ionizing ionic compound to the metallocene compound in the polymerization system becomes 0.5 to 30, preferably 1 to 25.

When the organoaluminum compound is used, the compound is fed in an amount of usually about 0 to 5 mmol/liter (polymerization volume), preferably about 0 to 2 mmol/liter.

In the copolymerization of ethylene, propylene, and if necessary, other monomers in the presence of the metallocene catalyst (b), the copolymerization reaction is carried out under the conditions of a temperature of usually −20 to 150° C., preferably 0to 120° C., more preferably to 0 to 100° C., and a pressure of more than 0 kg/cm$^2$ and not more than 80 kg/cm$^2$, preferably more than 0 kg/cm$^2$ and not more than 50 kg/cm$^2$. In a continuous polymerization process, these polymerization conditions are preferably held constant.

Although the reaction time (average residence time when the copolymerization is carried out continuously) varies depending upon the catalyst concentration, polymerization temperature, etc., it is in the range of usually 5 minutes to 5 hours, preferably 10 minutes to 3 hours.

Ethylene, propylene, and if necessary, other monomers are fed to the polymerization system in such amounts that the ethylene/propylene copolymer (A) having specific composition can be obtained. In the copolymerization, a molecular weight modifier such as hydrogen may be further used, and by the use of the molecular weight modifier, the weight-average molecular weight can be adjusted to 80,000 to 400,000.

When ethylene, propylene, and if necessary, other monomers are copolymerized as described above, the ethylene/propylene copolymer (A) is generally obtained as a polymer solution containing the copolymer. The polymer solution is treated in a conventional manner, whereby the ethylene/propylene copolymer (A) is obtained.

Preparation of Ethylene/propylene Copolymer (B)

The ethylene/propylene copolymer (B) is prepared by copolymerizing ethylene, propylene, and if necessary, other monomers in the presence of preferably the vanadium catalyst (a-2) or the metallocene catalyst (b) generally in a liquid phase. In the copolymerization, a hydrocarbon solvent is generally used as a polymerization solvent, but an α-olefin such as liquid propylene may be used.

Examples of the hydrocarbon solvents used in the polymerization include the same hydrocarbon solvents as previously described. These solvents can be used singly or in combination of two or more kinds.

Although ethylene, propylene, and if necessary, other monomers can be copolymerized by any of batchwise and continuous processes, the copolymerization is preferably carried out continuously, and is particularly preferably carried out continuously using a stirring vessel type reactor. When the copolymerization is carried out continuously, the catalyst is used in, for example, the following concentration.

When the vanadium catalyst (a-2) is used as a catalyst, the concentration of the soluble vanadium compound (v-2) in the polymerization system is in the range of usually 0.01 to 5 mmol/liter (polymerization volume), preferably 0.05 to 3 mmol/liter. It is desirable to feed the soluble vanadium compound (v-2) in a concentration of usually not more than 10 times, preferably 1 to 7 times, more preferably 1 to 5 times, the concentration of the soluble vanadium compound (v-2) present in the polymerization system. The organoaluminum compound is fed in such an amount that the molar ratio (Al/V) of the aluminum atom to the vanadium atom in the polymerization system becomes usually not less than 2, preferably 2 to 50, more preferably 3 to 20.

The soluble vanadium compound (v-2) and the organoaluminum compound are generally fed after diluted with the aforesaid hydrocarbon solvent and/or liquid propylene. The soluble vanadium compound (v-2) is desirably diluted to the above-mentioned concentration. On the other hand, the organoaluminum compound is desirably adjusted to, for example, an arbitrary concentration of not more than 50 times the concentration thereof in the polymerization system, followed by feeding to the polymerization system.

In the copolymerization of ethylene, propylene, and if necessary, other monomers in the presence of the vanadium catalyst (a-2), the copolymerization reaction is carried out under the conditions of a temperature of usually −50 to 100° C., preferably −30 to 80° C., more preferably −20 to 60° C., and a pressure of more than 0 kg/cm$^2$ and not more than 50 kg/cm$^2$, preferably more than 0 kg/cm$^2$ and not more than 20 kg/cm$^2$. In a continuous polymerization process, these polymerization conditions are preferably held constant.

When the metallocene catalyst (b) is used as a catalyst, the concentration of the metallocene compound in the polymerization system is in the range of usually 0.00005 to 0.1 mmol/liter (polymerization volume), preferably 0.0001 to 0.05 mmol/liter. The organoaluminum oxy-compound is fed in such an amount that the molar ratio (Al/transition metal) of the aluminum atom to the transition metal in the metallocene compound in the polymerization system becomes usually 1 to 10000, preferably 10 to 5000.

The ionizing ionic compound is fed in such an amount that themolar ratio (ionizing ionic compound/metallocene compound) of the ionizing ionic compound to the metallocene compound in the polymerization system becomes 0.5 to 30, preferably 1 to 25.

When the organoaluminum compound is used, the compound is fed in an amount of usually about 0 to 5 mmol/liter (polymerization volume), preferably about 0 to 2 mmol/liter.

In the copolymerization of ethylene, propylene, and if necessary, other monomers in the presence of the metallocene catalyst (b), the copolymerization reaction is carried out under the conditions of a temperature of usually −20 to 150° C., preferably 0 to 120° C., more preferably 0 to 100° C., and a pressure of more than 0 kg/cm$^2$ and not more than 80 kg/cm$^2$, preferably more than 0 kg/cm$^2$ and not more than 50 kg/cm$^2$. In a continuous polymerization process, these polymerization conditions are preferably held constant.

Although the reaction time (average residence time when the copolymerization is carried out continuously) varies depending upon the catalyst concentration, polymerization temperature, etc., it is in the range of usually 5 minutes to 5 hours, preferably 10 minutes to 3 hours.

Ethylene, propylene, and if necessary, other monomers are fed to the polymerization system in such amounts that the ethylene/propylene copolymer (B) having specific composition can be obtained. In the copolymerization, a molecular weight modifier such as hydrogen may be further used, and by the use of the molecular weight modifier, the weight-average molecular weight can be adjusted to not less than 80,000 and less than 250,000.

When ethylene, propylene, and if necessary, other monomers are copolymerized as described above, the ethylene/propylene copolymer (B) is generally obtained as a polymer solution containing the copolymer. The polymer solution is treated in a conventional manner, whereby the ethylente/propylene copolymer (B) is obtained.

Preparation of Ethylene/propylene Copolymer (C)

The ethylene/propylene copolymer (C) is prepared by copolymerizing ethylene, propylene, and if necessary, other monomers in the presence of preferably the vanadium catalyst (a-1) (more preferably the vanadium catalyst (a-2)) or the metallocene catalyst (b) generally in a liquid phase. In the copolymerization, a hydrocarbon solvent is generally used as a polymerization solvent, but an α-olefin such as liquid propylene may be used.

Examples of the hydrocarbon solvents used in the polymerization include the same hydrocarbon solvents as previously described. These solvents can be used singly or in combination of two or more kinds.

Although ethylene, propylene, and if necessary, other monomers can be copolymerized by any of batchwise and continuous processes, the copolymerization is preferably carried out continuously, and is particularly preferably carried out continuously using a stirring vessel type reactor. When the copolymerization is carried out continuously, the catalyst is used in, for example, the following concentration.

When the vanadium catalyst (a-1) is used as a catalyst, the concentration of the soluble vanadium compound (v-1) in the polymerization system is in the range of usually 0.01 to 5 mmol/liter (polymerization volume), preferably 0.05 to 3 mmol/liter. It is desirable to feed the soluble vanadium compound (v-1) in a concentration of usually not more than 10 times, preferably 1 to 7 times, more preferably 1 to 5 times, the concentration of the soluble vanadium compound (v-1) present in the polymerization system. The organoaluminum compound is fed in such an amount that the molar ratio (Al/V) of the aluminum atom to the vanadium atom in the polymerization system becomes usually not less than 2, preferably 2 to 50, more preferably 3 to 20.

The soluble vanadium compound (v-1) and the organoaluminum compound are generally fed after diluted with the aforesaid hydrocarbon solvent and/or liquid propylene. The soluble vanadium compound (v-1) is desirably diluted to the above-mentioned concentration. On the other hand, the organoaluminum compound is desirably adjusted to, for example, an arbitrary concentration of not more than 50 times the concentration thereof in the polymerization system, followed by feeding to the polymerization system.

In the copolymerization of ethylene, propylene, and if necessary, other monomers in the presence of the vanadium catalyst (a-1), the copolymerization reaction is carried out under the conditions of a temperature of usually −50 to 100° C., preferably −30 to 80° C., more preferably −20 to 60° C., and a pressure of more than 0 kg/cm$^2$ and not more than 50 kg/cm$^2$, preferably more than 0 kg/cm$^2$ and not more than 20 kg/cm$^2$. In a continuous polymerization process, these polymerization conditions are preferably held constant.

Also in the copolymerization of ethylene, propylene, and if necessary, other monomers in the presence of the vanadium catalyst (a-2), the same catalyst concentration and copolymerization conditions as described above are adopted.

When the metallocene catalyst (b) is used as a catalyst, the concentration of the metallocene compound in the polymerization system is in the range of usually 0.00005 to 0.1 mmol/liter (polymerization volume), preferably 0.0001 to 0.05 mmol/liter. The organoaluminum oxy-compound is fed in such an: amount that the molar ratio (Al/transition metal) of the aluminum atom to the transition metal in the metallocene compound in the polymerization system becomes usually 1 to 10000, preferably 10 to 5000.

The ionizing ionic compound is fed in such an amount that the molar ratio (ionizing ionic compound/metallocene compound) of the ionizing ionic compound to the metallocene compound in the polymerization system becomes 0.5 to 30, preferably 1 to 25.

When the organoaluminum compound is used, the compound is fed in an amount of usually about 0 to 5 mmol/liter (polymerization volume), preferably about 0 to 2 mmol/liter.

In the copolymerization of ethylene, propylene, and if necessary, other monomers in the presence of the metallocene catalyst (b), the copolymerization reaction is carried out under the conditions of a temperature of usually −20 to 150° C., preferably 0 to120° C., more preferably 0 to 100° C., and a pressure of more than 0 kg/cm$^2$ and not more than 80 kg/cm$^2$, preferably more than 0 kg/cm$^2$ and not more than 50 kg/cm$^2$. In a continuous polymerization process, these polymerization conditions are preferably held constant.

Although the reaction time (average residence time when the copolymerization is carried out continuously) varies depending upon the catalyst concentration, polymerization temperature, etc., it is in the range of usually 5 minutes to 5 hours, preferably 10 minutes to 3 hours.

Ethylene, propylene, and if necessary, other monomers are fed to the polymerization system in such amounts that the ethylene/propylene copolymer (C) having specific composition can be obtained. In the copolymerization, a molecular weight modifier such as hydrogen may be further used, and by the use of the molecular weight modifier, the weight-average molecular weight can be adjusted to 250,000 to 400,000.

When ethylene, propylene, and if necessary, other monomers are copolymerized as described above, the ethylente/propylene copolymer (C) is generally obtained as a polymer solution containing the copolymer. The polymer solution is treated in a conventional manner, whereby the ethylene/propylene copolymer (C) is obtained.

Lubricating Oil Composition

The lubricating oil composition according to the invention comprises:

any one of the ethylene/propylene copolymers (A), (B) and (C), and a lubricating oil base (D);

or comprises:

any one of the ethylene/propylene copolymers (A), (B) and (C), a lubricating oil base (D), and a pour point depressant (E).

The components for forming the lubricating oil composition of the invention are described below.

Lubricating Oil Base (D)

Examples of the lubricating oil bases (D) for use in the invention include mineral oils and synthetic oils such as poly-α-olefins, polyol esters and polyalkylene glycols. A mineral oil or a blend of a mineral oil and a synthetic oil is preferably employed. The mineral oil is generally used after subjected to purification such as dewaxing. Although mineral oils are divided into several classes according to the purification method, generally used is a mineral oil having a wax content of 0.5 to 10%. Further, a mineral oil having a kinematic viscosity of 10 to 200 cSt is generally used.

Pour Point Depressant

Examples of the pour point depressants (E) for use in the invention include alkylated naphthalene, (co) polymers of alkyl methacrylates, (co)polymers of alkyl acrylates, copolymers of alkyl fumarates and vinyl acetate, α-olefin polymers, and copolymers of α-olefins and styrene. Of these, (co)polymers of alkyl methacrylates and (co)polymers of alkyl acrylates are preferably employed.

One embodiment of the lubricating oil composition according to the invention comprises the ethylene/propylene copolymer (A) and the lubricating oil base (D), and contains the ethylene/propylene copolymer (A) in an amount of 1 to 20% by weight, preferably 5 to 10% by weight (residue: lubricating oil base (D) and later-described additives). The lubricating oil composition preferably contains the lubricating oil base (D) in an amount of 80 to 99% by weight and the ethylene/propylene copolymer (A) in an amount of 1 to 20% by weight, based on 100% by weight of the total of the lubricating oil base (D) and the ethylene/propylene copolymer (A).

The lubricating oil composition comprising the ethylene/propylene copolymer (A) and the lubricating oil base (D) shows small dependence on temperature and has excellent low-temperature properties. The lubricating oil composition can be used as it is as a lubricating oil, or can be further blended with a lubricating oil base, a pour point depressant, etc. prior to use as a lubricating oil.

Another embodiment of the lubricating oil composition according to the invention comprises the ethylene/propylene copolymer (B) and the lubricating oil base (D), and contains the ethylene/propylene copolymer (B) in an amount of 1 to 20% by weight, preferably 5 to 10% by weight (residue: lubricating oil base (D) and later-described additives). The lubricating oil composition preferably contains the lubricating oil base (D) in an amount of 80 to 99% by weight and the ethylene/propylene copolymer (B) in an amount of 1 to 20% by weight, based on 100% by weight of the total of the lubricating oil base (D) and the ethylene/propylene copolymer (B).

The lubricating oil composition comprising the ethylene/propylene copolymer (B) and the lubricating oil base (D) shows small dependence on temperature and has excellent low-temperature properties. The lubricating oil composition can be used as it is as a lubricating oil, or can be further blended with a lubricating oil base, a pour point depressant, etc. prior to use as a lubricating oil.

A further embodiment of the lubricating oil composition according to the invention comprises the ethylene/propylene copolymer (C) and the lubricating oil base (D), and contains the ethylene/propylene copolymer (C) in an amount of 1 to 20% by weight, preferably 5 to 10% by weight (residue: lubricating oil base (D) and later-described additives) . The lubricating oil composition preferably contains the lubricating oil base (D) in an amount of 80 to 99% by weight and the ethylene/propylene copolymer (C) in an amount of 1 to 20% by weight, based on 100% by weight of the total of the lubricating oil base (D) and the ethylene/propylene copolymer (C).

The lubricating oil composition comprising the ethylene/propylene copolymer (C) and the lubricating oil base (D) shows small dependence on temperature and has excellent low-temperature properties. The lubricating oil composition can be used as it is as a lubricating oil, or can be further blended with a lubricating oil base, a pour point depressant, etc. prior to use as a lubricating oil.

A still further embodiment of the lubricating oil composition according to the invention comprises the ethylene/propylene copolymer (A), the lubricating oil base (D) and the pour point depressant (E), and contains the ethylene/propylene copolymer (A) in an amount of 0.1 to 5% by weight, preferably 0.3 to 2% by weight, and the pour point depressant (E) in an amount of 0.05 to 5% by weight, preferably 0.1 to 2% by weight (residue: lubricating oil base (D) and later-described additives).

The lubricating oil composition comprising the ethylene/propylene copolymer (A), the lubricating oil base (D) and the pour point depressant (E) shows small dependence on temperature and small rise of the pour point, said rise being attributed to the interaction between the ethylene/propylene copolymer (A) and the pour point depressant (E), and has excellent low-temperature properties in every shear rate region. Further, the lubricating oil composition can satisfy low-temperature property standards of the GF-3 standards.

A still further embodiment of the lubricating oil composition according to the invention comprises the ethylene/propylene copolymer (B), the lubricating oil base (D) and the pour point depressant (E), and contains the ethylene/propylene copolymer (B) in an amount of 0.1 to 5% by weight, preferably 0.3 to 2% by weight, and the pour point depressant (E) in an amount of 0.05 to 5% by weight, preferably 0.1 to 2% by weight (residue: lubricating oil base (D) and later-described additives).

The lubricating oil composition comprising the ethylene/propylene copolymer (B), the lubricating oil base (D) and the pour point depressant (E) shows small dependence on temperature and small rise of the pour point, said rise being attributed to the interaction between the ethylene/propylene copolymer (B) and the pour point depressant (E), and has excellent low-temperature properties in every shear rate region. Further, the lubricating oil composition can satisfy low-temperature property standards of the GF-3 standards.

A still further embodiment of the lubricating oil composition according to the invention comprises the ethylene/propylene copolymer (C), the lubricating oil base (D) and the pour point depressant (E), and contains the ethylene/propylene copolymer (C) in an amount of 0.1 to 5% by weight, preferably 0.2 to 1.5% by weight, and the pour point depressant (E) in an amount of 0.05 to 5% by weight, preferably 0.1 to 2% by weight (residue: lubricating oil base (D) and later-described additives).

The lubricating oil composition comprising the ethylene/propylene copolymer (C), the lubricating oil base (D) and the pour point depressant (E) shows small dependence on temperature and small rise of the pour point, said rise being attributed to the interaction between the ethylene/propylene copolymer (C) and the pour point depressant (E), and has excellent low-temperature properties in every shear rate region. Further, the lubricating oil composition can satisfy low-temperature property standards of the GF-3 standards.

To the lubricating oil composition according to the invention, additives having effects of improving viscosity index, such as (co)polymers of alkyl methacrylates, hydrogenated SBR and SEBS, and other additives, such as detergent, rust preventive agent, dispersant, extreme pressure agent, anti-foaming agent, antioxidant and metal deactivator, may be added in addition to the above-mentioned components.

Preparation of Lubricating Oil Composition

The lubricating oil composition according to the invention can be prepared by mixing or dissolving the ethylene/propylene copolymer (A), (B) or (C), and if necessary, additives with or in the lubricating oil base (D) by a known method, or by mixing or dissolving the ethylene/propylene copolymer (A), (B) or (C), the pour point depressant (E), and if necessary, additives with or in the lubricating oil base (D) by a known method.

In the present specification, all numerical values for the amounts of materials, reaction conditions, molecular weight, carbon atom number, etc. are desirably understood with supplement of a term "about" so long as their meanings are not technically indefinite, with the exception of the following examples or unless otherwise stated.

Effect of the Invention

The viscosity modifier for a lubricating oil according to the invention can produce a viscosity modifier having excellent low-temperature properties.

The lubricating oil composition according to the invention has excellent low-temperature properties and is favorably applied to various lubricating oil uses.

EXAMPLE

The present invention is further described with reference to the following examples, but it should be construed that the invention is in no way limited to those examples.

In the examples, various properties were measured by the methods described below.

Ethylene Content

The ethylene content was measured in a mixed solvent of orthodichlorobenzene and benzene-d6 (orthdichlorobenzene/benzene-d6=3/1–4/1, by volume) using a nuclear magnetic resonance apparatus of Japan Electron Optics Laboratory LA500 Model under the conditions of a temperature of 120° C., a pulse width of 45° pulse and a pulse repetition time of 5.5 seconds.

Viscosity at 100° C. (K.V.)

The viscosity was measured in accordance with ASTM D 445. In the examples, adjustment was made so as to obtain K.V. of about 10 $mm^2$/sec.

Cold Cranking Simulator (CCS)

CCS was measured in accordance with ASTM D 2602. The CCS was used to evaluate sliding properties (starting properties) at the crank shaft at low temperatures. A smaller value of CCS indicates better low-temperature properties of a lubricating oil.

Mini-Rotary Viscometer (MRV)

MRV was measured in accordance with ASTM D 3829 and D 4684. The MRV was used to evaluate pumping performance of an oil pump at low temperatures. A smaller value of MRV indicates better low-temperature properties of a lubricating oil.

Shear Stability Index (SSI)

SSI was measured in accordance with ASTM D 3945. The SSI is a measure of kinematic viscosity loss that occurs by scission of molecular chain of a copolymer component in a lubricating oil when a shear force is applied to the lubricating oil during the sliding motion. A larger value of SSI indicates larger loss of kinematic viscosity.

Low-temperature Flowability

After cooling at −18° C. for 2 weeks, flowability (appearance) of a lubricating oil was observed and evaluated as follows.

AA: The lubricating oil flows.

BB: The lubricating oil does not flow (in gel state).

Polymerization Example 1

Synthesis of Ethylene/propylene Copolymer

In a 2-liter continuous polymerization reactor equipped with a stirring blade, said reactor having been thoroughly purged with nitrogen, 1 liter of dehydrated and purified hexane was placed. To the reactor, a hexane solution of ethylaluminum sesquichloride ($Al(C_2H_5)_{1.5}\cdot Cl_{1.5}$) adjusted to have a concentration of 8.0 mmol/l was continuously fed for 1 hour at a rate of 500 ml/hr. Then, to the reactor were further continuously fed a hexane solution of $VO(OC_2H_5)Cl_2$ (as a catalyst) adjusted to have a concentration of 0.8 mmol/l at a rate of 500 ml/hr and hexane (as a polymerization solvent) at a rate of 500 ml/hr. On the other hand, the polymer solution was continuously drawn out from the top of the polymerization reactor so that the amount of the polymer solution in the reactor would be invariably 1 liter. To the reactor were furthermore fed ethylene at a rate of 250 l/hr, propylene at a rate of 50 l/hr and hydrogen at a rate of 5 l/hr using a bubbling tube. The copolymerization reaction was carried out at 50° C. by circulating a cooling medium through a jacket equipped outside the polymerization reactor.

Through the reaction under the above conditions, a polymer solution containing an ethylene/propylene copolymer was obtained. The polymer solution was deashed by the use of hydrochloric acid and then introduced into a large amount of methanol to precipitate an ethylene/propylene copolymer. The resulting copolymer was dried under vacuum at 130° C. for 24 hours. Properties of the copolymer are shown in Table 1.

Polymerization Example 2

The procedure of Polymerization Example 1 was repeated, except that $VOCl_3$ was used instead of $VO(OC_2H_5)Cl_2$. The results are shown in Table 1.

TABLE 1

| | Polymerization Ex. 1 | Polymerization Ex. 2 |
|---|---|---|
| Polymerization conditions | | |
| Ethylene (1/hr) | 240 | 240 |
| Propylene (1/hr) | 60 | 60 |
| Hydrogen (1/hr) | 12 | 12 |
| Polymer properties | | |
| Ethylene content (wt %) | 75.7 | 75.6 |
| Mw (in terms of PS) × $10^4$ | 18.1 | 17.8 |
| Mw/Mn | 1.9 | 2.4 |
| Tm (° C.) | 47.2 | 56.2 |
| 3.44 × E−206 | 54.4 | 54.1 |
| Melt viscosity ratio ($\eta$*0.01/$\eta$*8) | 1.17 | 1.17 |
| Density (kg/m$^3$) | 873 | 873 |
| 1.247 × D−1037 | 51.6 | 51.6 |
| Sαβ/Sαα | 1.5 | 1.5 |

Example 1

A lubricating oil composition, which was composed of 88.88% by weight of a mixed oil of 100 Neutral (trade name, mineral oil available from ESSO Co.) and 150 Neutral (trade name, mineral oil available from ESSO Co.) in a mixing ratio of 80:20 as a lubricating oil base, 0.62% by weight of the ethylene/propylene copolymer obtained in Polymerization Example 1, 0.50% by weight of A clube 133 (trade name, available from Sanyo Kasei Co.) as a pour point depressant and 10% by weight of a detergent dispersant (available from Lubrizole Co.), was evaluated on the lubricating oil performance and the flowability at low temperatures. The results are shown in Table 2.

Comparative Example 1

The procedure of Example 1 was repeated, except that the types of the lubricating oil base and the ethylene/propylene copolymer were changed. The results are shown in Table 2.

TABLE 2

| Type of ethylene/propylene copolymer | Ex. 1 Polymerization Ex. 1 | Comp. Ex. 1 Polymerization Ex. 2 |
|---|---|---|
| Blending proportion (wt %) | | |
| Lubricating oil base | 88.88 | 88.88 |
| Detergent dispersant | 10.00 | 10.00 |
| Ethylene/propylene copolymer | 0.62 | 0.62 |
| Pour point depressant | 0.50 | 0.50 |
| Lubricating oil performance | | |
| K.V. (at 100° C.) (mm$^2$/s) | 10.02 | 10.01 |
| SSI | 23.0 | 23.0 |
| CCS | 2,790 | 2,820 |
| MRV | 25,500 | 32,100 |
| Low-temperature flowability | AA | BB |
| Lubricating oil appearance | colorless and transparent | opaque white |

Polymerization Example 3

Synthesis of Ethylene/propylene Copolymer

In a 2-liter continuous polymerization reactor equipped with a stirring blade, said reactor having been thoroughly purged with nitrogen, 1 liter of dehydrated and purified hexane was placed. To the reactor, a hexane solution of ethylaluminum sesquichloride ($Al(C_2H_5)_{1.5}\cdot Cl_{1.5}$) adjusted to have a concentration of 8.0 mmol/l was continuously fed for 1 hour at a rate of 500 ml/hr. Then, to the reactor were further continuously fed a hexane solution of $VO(OC_2H_5)Cl_2$ (as a catalyst) adjusted to have a concentration of 0.8 mmol/l at a rate of 500 ml/hr and hexane (as a polymerization solvent) at a rate of 500 ml/hr. On the other hand, the polymer solution was continuously drawn out from the top of the polymerization reactor so that the amount of the polymer solution in the reactor would be invariably 1 liter. To the reactor were furthermore fed ethylene at a rate of 250 l /hr, propylene at a rate of 50 l/hr and hydrogen at a rate of 5 l/hr using a bubbling tube. The copolymerization reaction was carried out at 35° C. by circulating a cooling medium through a jacket equipped outside the polymerization reactor.

Through the reaction under the above conditions, a polymer solution containing an ethylene/propylene copolymer was obtained. The polymer solution was deashed by the use of hydrochloric acid and then introduced into a large amount of methanol to precipitate an ethylene/propylene copolymer. The resulting copolymer was dried under vacuum at 130° C. for 24 hours. Properties of the copolymer are shown in Table 3.

Polymerization Examples 4–6

The procedure of Polymerization Example 3 was repeated, except that the feed rates of ethylene, propylene and hydrogen were changed as shown in Table 3. The results are shown in Table 3.

TABLE 3

| | Polymerization Ex. 3 | Polymerization Ex. 4 | Polymerization Ex. 5 | Polymerization Ex. 6 |
|---|---|---|---|---|
| Polymerization conditions | | | | |
| Ethylene (1/hr) | 250 | 240 | 230 | 220 |
| Propylene (1/hr) | 50 | 60 | 70 | 80 |
| Hydrogen (1/hr) | 5 | 5 | 4 | 4 |
| Polymer properties | | | | |
| Ethylene content (wt %) | 80.2 | 75.4 | 70.5 | 66.2 |
| MW (in terms of PS) × $10^4$ | 30.7 | 29.2 | 30.2 | 28.5 |
| Mw/Mn | 1.9 | 1.9 | 2.0 | 2.0 |
| Tm (° C.) | 62.8 | 45.1 | 30.2 | 14.1 |
| 3.44 × E−204 | 71.9 | 55.4 | 38.5 | 23.7 |
| Melt viscosity ratio (η*0.01/η*8) | 2.05 | 1.87 | 1.93 | 1.71 |
| Density (kg/$m^3$) | 887 | 872 | 859 | unmeasured |
| 1.247 × D−1037 | 69.1 | 50.4 | 34.2 | unmeasured |
| Sαβ/Sαα | 1.5 | 1.5 | 1.5 | 1.4 |

Example 2

A lubricating oil composition, which was composed of 89.04% by weight of a mixed oil of 100 Neutral (trade name, mineral oil available from ESSO Co.) and 150 Neutral (trade5 name, mineral oil available from ESSO Co.) in a mixing ratio of 80:20 as a lubricating oil base, 0.46% by weight of the ethylene/propylene copolymer obtained in Polymerization Example 4, 0.5% by weight of Aclube 133 (trade name, available from Sanyo Kasei Co.) as a pour point depressant and 10% by weight of a detergent dispersant (available from Lubrizole Co.), was evaluated on the lubricating oil performance and the flowability at low temperatures. The results are shown in Table 4.

Example 3, Comparative Examples 2 and 3

The procedure of Example 2 was repeated, except that the types and the amounts of the lubricating oil base and the ethylene/propylene copolymer were changed. The results are shown in Table 4.

TABLE 4

| Type of ethylene/propylene copolymer | Ex. 2 Polymerization Ex. 4 | Ex. 3 Polymerization Ex. 5 | Comp. Ex. 2 Polymerization Ex. 3 | Comp. Ex. 3 Polymerization Ex. 6 |
|---|---|---|---|---|
| Blending proportion (wt %) | | | | |
| Lubricating oil base | 89.04 | 89.04 | 89.05 | 89.00 |
| Detergent dispersant | 10.00 | 10.00 | 10.00 | 10.00 |

TABLE 4-continued

| Type of ethylene/propylene copolymer | Ex. 2 Polymerization Ex. 4 | Ex. 3 Polymerization Ex. 5 | Comp. Ex. 2 Polymerization Ex. 3 | Comp. Ex. 3 Polymerization Ex. 6 |
|---|---|---|---|---|
| Ethylene/propylene copolymer | 0.46 | 0.46 | 0.45 | 0.50 |
| Pour point depressant | 0.50 | 0.50 | 0.50 | 0.50 |
| Lubricating oil performance | | | | |
| K.V. (@ 100° C.) ($mm^2$/s) | 10.02 | 10.05 | 10.02 | 10.04 |
| SSI | 45.0 | 46.0 | 45.0 | 43.5 |
| CCS | 2,620 | 2,820 | 2,600 | 2,850 |
| MRV | 21,000 | 44,500 | 21,200 | solidified |
| Low-temperature flowability | AA | AA | BB | AA |

What is claimed is:

1. A viscosity modifier for a lubricating oil, comprising an ethylene/propylene copolymer (A) having the following properties (a-1) to (a-5):

(a-1) the density is in the range of 857 to 882 kg/$m^3$, (a-2) the weight-average molecular weight as measured by gel permeation chromatography is in the range of 80,000 to 400,000 in terms of polystyrene, (a-3) Mw/Mn (Mw: weight-average molecular weight, Mn: number-average molecular weight), which is an indication of a molecular weight distribution, is not more than 2.3, (a-4) the melting point as measured by a differential scanning calorimeter is in the range of 15 to 60° C., and (a-5) the density (D (kg/$m^3$)) and the melting point (Tm (° C.)) as measured by a differential scanning calorimeter satisfy the following relation (I)

$$Tm \leqq 1.247 \times D - 1037 \quad \text{(I)}.$$

2. A viscosity modifier for a lubricating oil, comprising an ethylene/propylene copolymer (B) having the following properties (b-1) to (b-5):

(b-1) the content of recurring units derived from ethylene is in the range of 70 to 79% by weight, (b-2) the weight-average molecular weight as measured by gel permeation chromatography is not less than 80,000 and less than 250,000 in terms of polystyrene, (b-3) Mw/Mn (Mw: weight-average molecular weight, Mn: number-average molecular weight), which is an indication of a molecular weight distribution, is not more than 2.3, (b-4) the melting point as measured by a differential scanning calorimeter is in the range of 15 to 60° C., and (b-5) the content (E (% by weight)) of recurring units derived from ethylene and the melting point (Tm (C)) as measured by a differential scanning calorimeter satisfy the following relation (II)

$$3.44 \times E - 206 \geqq Tm \quad \text{(II)}.$$

3. A viscosity modifier for a lubricating oil, comprising an ethylene/propylene copolymer (C) having the following properties (c-1) to (c-5):

(c-1) the content of recurring units derived from ethylene is in the range of 70 to 79% by weight, (c-2) the weight-average molecular weight as measured by gel permeation chromatography is in the range of 250,000 to 400,000 in terms of polystyrene, (c-3) Mw/Mn (Mw: weight-average molecular weight, Mn: number-average molecular weight), which is an indication of a molecular weight distribution, is not more than 2.3, (c-4) the melting point as measured by a differential scanning calorimeter is in the range of 15 to 60° C., and (c-5) the content (E (% by weight)) of recurring units derived from ethylene and the melting point (Tm (° C.)) as measured by a differential scanning calorimeter satisfy the following relation (III)

$$3.44 \times E - 204 \geqq Tm \quad \text{(III).}$$

4. A lubricating oil composition comprising:

(A) an ethylene/propylene copolymer, and (D) a lubricating oil base, wherein the ethylene/propylene copolymer (A) is contained in an amount of 1 to 20% by weight and has the following properties (a-1) to (a-5):

(a-1) the density is in the range of 857 to 882 kg/m$^3$, (a-2) the weight-average molecular weight as measured by gel permeation chromatography is in the range of 80,000 to 400,000 in terms of polystyrene, (a-3) Mw/Mn (Mw: weight-average molecular weight, Mn: number-average molecular weight), which is an indication of a molecular weight distribution, is not more than 2.3, (a-4) the melting point as measured by a differential scanning calorimeter is in the range of 15 to 60° C., and (a-5) the density (D (kg/m$^3$)) and the melting point (Tm (° C.)) as measured by a differential scanning calorimeter satisfy the following relation (I)

$$Tm \leqq 1.247 \times D - 1037 \quad \text{(I).}$$

5. A lubricating oil composition comprising:

(B) an ethylene/propylene copolymer, and (D) a lubricating oil base, wherein the ethylene/propylene copolymer (B) is contained in an amount of 1 to 20% by weight and has the following properties (b-1) to (b-5):

(b-1) the content of recurring units derived from ethylene is in the range of 70 to 79% by weight, (b-2) the weight-average molecular weight as measured by gel permeation chromatography is not less than 80,000 and less than 250,000 in terms of polystyrene, (b-3) Mw/Mn (Mw: weight-average molecular weight, Mn: number-average molecular weight), which is an indication of a molecular weight distribution, is not more than 2.3, (b-4) the melting point as measured by a differential scanning calorimeter is in the range of 15 to 60° C., and (b-5) the content (E (% by weight)) of recurring units derived from ethylene and the melting point (Tm (° C.)) as measured by a differential scanning calorimeter satisfy the following relation (II)

$$3.44 \times E - 206 \geqq Tm \quad \text{(II).}$$

6. A lubricating oil composition comprising:

(C) an ethylene/propylene copolymer, and (D) a lubricating oil base, wherein the ethylene/propylene copolymer (C) is contained in an amount of 1 to 20% by weight and has the following properties (c-1) to (c-5):

(c-1) the content of recurring units derived from ethylene is in the range of 70 to 79% by weight, (c-2) the weight-average molecular weight as measured by gel permeation chromatography is in the range of 250,000 to 400,000 in terms of polystyrene, (c-3) Mw/Mn (Mw: weight-average molecular weight, Mn: number-average molecular weight), which is an indication of a molecular weight distribution, is not more than 2.3, (c-4) the melting point as measured by a differential scanning calorimeter is in the range of 15 to 60° C., and (c-5) the content (E (% by weight)) of recurring units derived from ethylene and the melting point (Tm (° C.)) as measured by a differential scanning calorimeter satisfy the following relation (III)

$$3.44 \times E - 204 \geqq Tm \quad \text{(III).}$$

7. A lubricating oil composition comprising:

(A) an ethylene/propylene copolymer, (D) a lubricating oil base, and (E) a pour point depressant, wherein the ethylene/propylene copolymer (A) is contained in an amount of 0.1 to 5% by weight, the pour point depressant (E) is contained in an amount of 0.05 to 5% by weight, and the ethylene/propylene copolymer (A) has the following properties (a-1) to (a-5):

(a-1) the density is in the range of 857 to 882 kg/m$^3$, (a-2) the weight-average molecular weight as measured by gel permeation chromatography is in the range of 80,000 to 400,000 in terms of polystyrene, (a-3) Mw/Mn (Mw: weight-average molecular weight, Mn: number-average molecular weight), which is an indication of a molecular weight distribution, is not more than 2.3, (a-4) the melting point as measured by a differential scanning calorimeter is in the range of 15 to 60° C., and (a-5) the density (D (kg/m$^3$)) and the melting point (Tm (° C.)) as measured by a differential scanning calorimeter satisfy the following relation (I)

$$Tm \leqq 1.247 \times D - 1037 \quad \text{(I).}$$

8. A lubricating oil composition comprising:

(B) an ethylene/propylene copolymer, (D) a lubricating oil base, and (E) a pour point depressant, wherein the ethylene/propylene copolymer (B) is contained in an amount of 0.1 to 5% by weight, the pour point depressant (E) is contained in an amount of 0.05 to 5% by weight, and the ethylene/propylene copolymer (B) has the following properties (b-1) to (b-5):

(b-1) the content of recurring units derived from ethylene is in the range of 70 to 79% by weight, (b-2) the weight-average molecular weight as measured by gel permeation chromatography is not less than 80,000 and less than 250,000 in terms of polystyrene, (b-3) Mw/Mn (Mw: weight-average molecular weight, Mn: number-average molecular weight), which is an indication of a molecular weight distribution, is not more than 2.3, (b-4) the melting point as measured by a differential scanning calorimeter is in the range of 15 to 60° C., and (b-5) the content (E (% by weight)) of recurring units derived from ethylene and the melting point (Tm (° C.)) as measured by a differential scanning calorimeter satisfy the following relation (II)

$$3.44 \times E - 206 \geqq Tm \quad \text{(II)}.$$

9. A lubricating oil composition comprising:

(C) an ethylene/propylene copolymer, (D) a lubricating oil base, and (E) a pour point depressant, wherein the ethylene/propylene copolymer (C) is contained in an amount of 0.1 to 5% by weight, the pour point depressant (E) is contained in an amount of 0.05 to 5% by weight, and the ethylene/propylene copolymer (C) has the following properties (c-1) to (c-5):

(c-1) the content of recurring units derived from ethylene is in the range of 70 to 79% by weight, (c-2) the weight-average molecular weight as measured by gel permeation chromatography is in the range of 250,000 to 400,000 in terms of polystyrene, (c-3) Mw/Mn (Mw: weight-average molecular weight, Mn: number-average molecular weight), which is an indication of a molecular weight distribution, is not more than 2.3, (c-4) the melting point as measured by a differential scanning calorimeter is in the range of 15 to 60° C., and (c-5) the content (E (% by weight)) of recurring units derived from ethylene and the melting point (Tm (° C.)) as measured by a differential scanning calorimeter satisfy the following relation (III)

$$3.44 \times E - 204 \geqq Tm \quad \text{(III)}.$$

* * * * *